US005204655A

United States Patent [19]

Yajima et al.

[11] Patent Number: 5,204,655

[45] Date of Patent: Apr. 20, 1993

[54] RESISTOR ELEMENT WITH A PLANAR CERAMIC SUBSTRATE COVERED WITH A RESISTIVE METALLIC FILM AND HAVING APERTURES FOR LEAD WIRE CONNECTION

[75] Inventors: Yasuhiro Yajima; Takayuki Ogasawara, both of Nagoya, Japan

[73] Assignee: NGK Insulators, Ltd., Japan

[21] Appl. No.: 756,885

[22] Filed: Sep. 9, 1991

[30] Foreign Application Priority Data

Sep. 13, 1990 [JP] Japan ..... 2-245677

[51] Int. Cl.[5] ..... H01C 1/12

[52] U.S. Cl. ..... 338/312; 338/329; 338/308; 338/293

[58] Field of Search ..... 338/312, 329, 308, 309, 338/280, 293, 285, 332

[56] References Cited

U.S. PATENT DOCUMENTS

| | | | |
|---|---|---|---|
| 2,651,833 | 9/1953 | Kernahan | 338/312 X |
| 3,277,232 | 10/1966 | Ragan | 338/312 X |
| 3,496,283 | 2/1970 | Andrasfay | 338/312 X |
| 4,127,934 | 12/1978 | Bartley et al. | 338/312 X |
| 4,174,513 | 11/1979 | Wellard | 338/312 |
| 4,213,113 | 7/1980 | Brandt et al. | 338/309 |
| 4,400,762 | 8/1983 | Bartley et al. | 338/329 X |
| 4,450,347 | 5/1984 | Courvoisier et al. | 388/293 X |
| 4,513,615 | 4/1985 | Sato et al. . | |
| 4,903,001 | 2/1990 | Kikuchi . | |
| 4,920,635 | 5/1990 | Yajima . | |

*Primary Examiner*—Marvin M. Lateef

*Attorney, Agent, or Firm*—Parkhurst, Wendel & Rossi

[57] ABSTRACT

A resistor element for determining a parameter, including a planar ceramic substrate having a bearing surface and at least one aperture formed through the thickness thereof, an electrically resistive metallic layer which is substantially formed on the bearing surface of the ceramic substrate and has at least one extension which covers an inner wall surface of the above-indicated at least one aperture, a pair of conductors for connecting the resistive metallic layer to an external circuit, at least one of the pair of conductors being inserted into a corresponding one of the above-indicated at least one aperture of the ceramic substrate, and an electrically conductive adhesive at least partially filling each of the above-indicated at least one aperture, for securing an end portion of the corresponding one of the pair of conductors to the ceramic substrate, the electrically conductive adhesive electrically connecting the above-indicated at least one conductor to the above-indicated at least one extension of the resistive metallic layer.

10 Claims, 2 Drawing Sheets

RESISTOR ELEMENT WITH A PLANAR CERAMIC SUBSTRATE COVERED WITH A RESISTIVE METALLIC FILM AND HAVING APERTURES FOR LEAD WIRE CONNECTION

BACKGROUND OF THE INVENTION

1. Field of the Invention

The present invention relates in general to a resistor element having a thin electrically resistive film, and more particularly to such a resistor element which is suitably used for a temperature sensor or a thermal flow meter, for example.

2. Discussion of the Related Art

One example of the resistor element having a thin metallic film as shown in FIG. 1 is proposed by the assignee of the present application, and is disclosed in co-pending application, Ser. No. 07/669,007 filed on Mar. 13, 1991. This resistor element includes a ceramic substrate 2 made of alumina, for example, and a thin metallic film 4 formed in a suitable pattern on one major surface of the substrate 2 so as to have a predetermined resistance value. The metallic film 4 is made of platinum, for example. This metallic film 4 is electrically connected to a pair of lead wires 6, 6, made of platinum, for example, at opposite end portions of the ceramic substrate 2, by an electrically conductive adhesive 8 which is a mixture of an electrically conductive material, such as platinum, and glass. On the upper surface of the ceramic substrate 2 on which the metallic film 4 is formed, there is provided a protective coating layer 10 made of glass, for example, which has a suitable thickness.

In this type of resistor element, end portions of the lead wires 6 are disposed on the metallic film 4 formed on the ceramic substrate 2, and then coated with the electrically conductive adhesive 8 so that the lead wires 6 are electrically connected to the metallic film 4. However, this arrangement unfavorably increases an overall thickness of the resistor element, causing some trouble when the resistor element is installed on various devices, such as a temperature sensor. Further, the resistor element constructed as described above has another drawback. If various external forces act on the lead wires 6 while an electrically conductive paste applied to the metallic film 4 is dried and then heat-treated to form the adhesive 8 in the process of fabricating the resistor element, or while the lead wires 6 are handled during practical use of the element, the conductive adhesive 8 is subjected to stress, and suffers from cracks, resulting from the stress. Thus the conventional resistor element constructed as described above suffers from some problems such as low operating reliability and durability.

SUMMARY OF THE INVENTION

The present invention was developed in the light of the above circumstances of the related art. It is therefore an object of the invention to provide an improved resistor element whose overall thickness is relatively small, and which effectively prevents cracking of an electrically conductive paste or adhesive for electrically connecting lead wires to an electrically resistive metallic layer, during practical use of the resistor element.

The above object may be accomplished according to the principle of the present invention, which provides a resistor element for determining a parameter, comprising; (a) a planar ceramic substrate having opposite major surfaces one of which provides a bearing surface, and at least one aperture formed through the thickness thereof; (b) an electrically resistive metallic layer which is substantially formed on the bearing surface of the ceramic substrate, the resistive metallic layer having at least one extension which covers an inner wall surface of the above-indicated at least one aperture; (c) a pair of conductors for connecting the resistive metallic layer to an external circuit, at least one of the pair of conductors being inserted into a corresponding one of the above-indicated at least one aperture of the ceramic substrate; and (d) an electrically conductive adhesive at least partially filling each of the above-indicated at least one aperture, for securing an end portion of the corresponding one of the pair of conductors to the ceramic substrate, the electrically conductive adhesive electrically connecting the above-indicated at least one conductor to the above-indicated at least one extension of the resistive metallic layer.

In the resistor element constructed according to the present invention, the resistive metallic layer formed on one major surface of the ceramic substrate having at least one aperture or hole has an integrally formed extension or extensions each of which covers the inner wall surface or surfaces of the corresponding aperture or hole of the ceramic substrate. In this arrangement, the lead wires may be inserted into the respective apertures or holes and electrically connected to the extensions of the resistive metallic layer formed on the inner wall surfaces of the apertures or holes, by the electrically conductive adhesive which is applied to these apertures or holes. Consequently, there is no need to apply the adhesive to the bearing surface of the substrate, whereby the overall thickness of the resistor element is not increased by the adhesive. Further, in the present resistor element, cracks which may occur at the portions of the element where the adhesive is applied to secure the lead wires to the ceramic substrate can be advantageously avoided even if a force is applied to the lead wires during manufacturing process or practical use of the resistor element. Therefore, the resistor element according to the present invention exhibits effectively improved durability.

BRIEF DESCRIPTION OF THE DRAWINGS

The foregoing and other objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
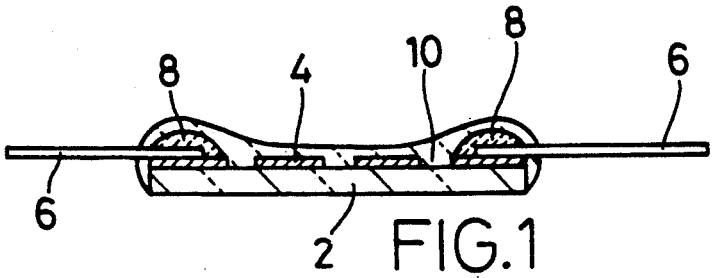
FIG.1 PRIOR ART
FIG. 1 is an elevational view in longitudinal cross section of a resistor element which is proposed by the assignee of the present application and over which the present invention provides an improvement.
Figure 2A:
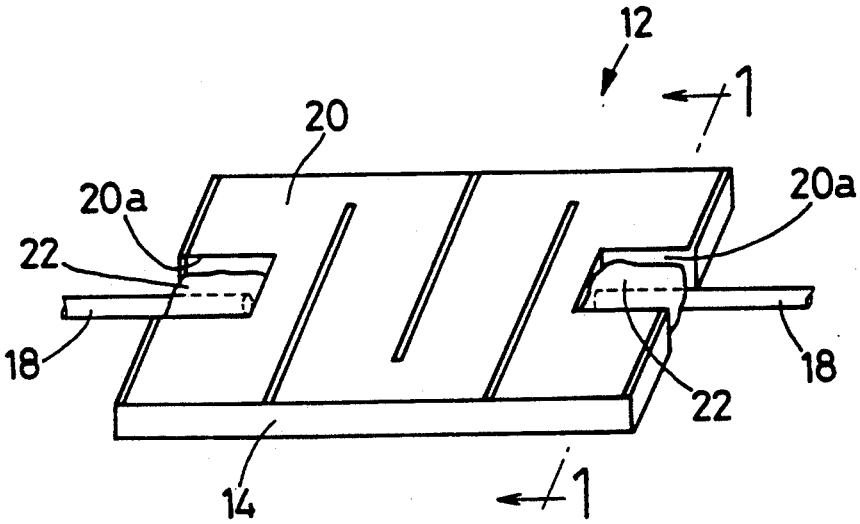
FIG. 2(*a*) is a perspective view of one embodiment of a resistor element of the present invention, and FIG. 2(*b*) is a cross sectional view taken along line 1—1 of FIG. 2(*a*)
Figure 2B:
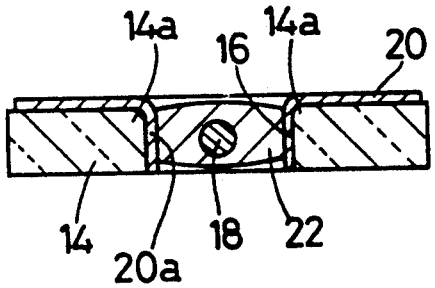

Referring first to FIGS. 2(*a*) and 2(*b*), there is illustrated one embodiment of the resistor element of the present invention.

As shown in the drawings, the resistor element 12 includes a planar ceramic substrate 14 made of a known ceramic material such as alumina, and a relatively thin electrically resistive metallic layer 20 which is formed o one of opposite major surfaces of the substrate 14. The ceramic substrate 14 has a pair of apertures in the form of two cutouts 16, 16 formed through the thickness thereof at its longitudinally opposite end portions. A pair of lead wires 18, 18 are inserted suitable distances at their end portions into respective cutouts 16 of the ceramic substrate 14, and are bonded and secured to the ceramic substrate 14 by respective masses of an electrically conductive adhesive 22.

Figure 3:
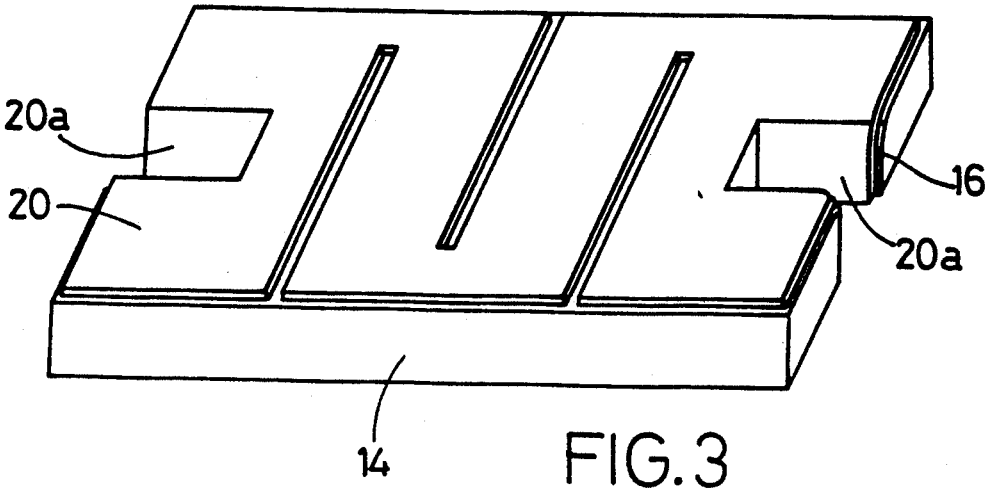
FIG. 3 is a perspective view of the resistor element of FIGS. 2(*a*) and 2(*b*) before lead wires are secured to a ceramic substrate of the element.

Described more specifically, the planar ceramic substrate 14 assumes a rectangular shape as shown in FIG. 3, and has the pair of cutouts 16, 16 having a suitable size at the longitudinally opposite end portions thereof such that each cutout 16 is open on the respective longitudinal end face of the substrate 14. The electrically resistive metallic layer 20 made of a suitable metal such as platinum is formed on the upper bearing surface of the ceramic substrate 14, by a known physical or chemical method such as sputtering, plating, chemical vapor deposition (CVD) or vacuum evaporation, and then trimmed by a laser in a suitable pattern. The resistive metallic layer 20 formed on the ceramic substrate 14 has integrally formed extensions 20*a* which cover inner wall surfaces of each cutout 16 of the substrate 14. The resistive metallic layer 20 may be formed in various manners other than those described above. For example, a slurry which is obtained by dispersing a suitable metallic powder in an organic vehicle is applied over the upper surface of the ceramic substrate 14, and then heat-treated to provide the resistive metallic layer 20. The obtained resistive metallic layer 20 is trimmed by a laser in a suitable pattern as described above.

Generally, the upper surface of the ceramic substrate 14 and the inner walls of the cutouts 16 form corners having right-angle edges. Accordingly, the resistive metallic layer 20 covering the upper surface and the extensions 22 covering the inner wall surfaces may be strained away from each other and eventually torn at the corners of the substrate 14 during firing of the resistor element. In the present embodiment, the right-angle corners of the ceramic substrate 14 are chamfered or rounded at the boundaries between the upper surface of the substrate 14 and the inner walls of the cutouts 16, to thereby provide chamfered or rounded portions 14*a*. Each chamfered portion 14*a* has a suitable radius of curvature. These chamfered portions 14*a* effectively prevent the resistive metallic layer 20 formed on the substrate 14 from being torn at the boundaries between the upper surface of the substrate 14 and the inner wall surfaces of the cutouts 16 during firing of the resistor element as described later.

It is desirable that the radius of curvature of each chamfered or rounded portion 14*a* is at least 5 μm, preferably at least 10 μm. The inventors of the present invention conducted an experiment using a ceramic substrate (14) whose chamfered portions (14*a*) have a radius of curvature of 8 μm. On the upper surface of the ceramic substrate (14) prepared as described above, an electrically resistive platinum layer (20) having a thickness of 4000 Å was formed by sputtering, heat-treated at 900° C., for 30 minutes. It was confirmed from the experiment that the platinum layer (20) was free from tearing or cutting at the chamfered portions (14*a*).

The lead wires 18, 18 made of a metallic material such as stainless steel or platinum are secured to the longitudinal opposite end portions of the ceramic substrate 14 on which the resistive metallic layer 20 is formed in the manner as described above. Namely, the lead wires 18 are inserted suitable distances at their end portions into the respective cutouts 16 of the ceramic substrate 14 in a direction parallel to the plane of the ceramic substrate 14. In this condition, the end portions of the lead wires which are inserted into the respective cutouts 16 are bonded to the ceramic substrate 14 by the respective masses of the electrically conductive adhesive 22, which are applied so as to fill the cutouts 16. Then, the substrate 14 is heat-treated by a suitable known method, whereby the lead wires 18 are firmly secured to the ceramic substrate 14.

Thus, the lead wires 18 are electrically connected to the extensions 20*a* of the resistive metallic layer 20 which cover the inner wall surfaces of the cutouts 16 of the ceramic substrate 14, by the electrically conductive adhesive 22. While the adhesive 22 may be selected from any known electrically conductive adhesives capable of bonding the resistive metallic layer 20 and the lead wires 18, it is generally preferable to employ a mixture of platinum and glass as the adhesive 22. The instant resistor element 12 further has a protective coating layer as used in conventional resistor elements, for covering the upper surface of the ceramic substrate 14. The protective coating layer has a suitable thickness and is made of glass, for example.

The resistor element 12 constructed as described above is connected to an external circuit by the lead wires 18 in the manner known in the art, and is suitably used for a temperature sensor or other devices.

In the resistor element 12 constructed according to the present invention, the lead wires 18 are electrically connected to the extensions 20*a* of the resistive metallic layer 20, which are formed on the inner wall surfaces of the cutouts 16 of the ceramic substrate 14, by the electrically conductive adhesive 22. The adhesive 22 for securing the lead wires 18 to the substrate 14 only fills each cutout 16 of the substrate 14 and does not exist on the upper surface of the ceramic substrate 14. It consequently contributes to preventing an increase in the overall thickness of the resistive element. Further, even if external forces act on the lead wires 18 in the process of manufacture of the resistor element or upon handling of the element in practical use, the electrically conductive adhesive 22 for securing the lead wires 18 to the ceramic substrate 14 is effectively protected against cracks or deformation, since the adhesive 22 is surrounded by the inner wall surfaces of the cutouts 16 and thus reinforced by the substrate 14.

Figure 4:
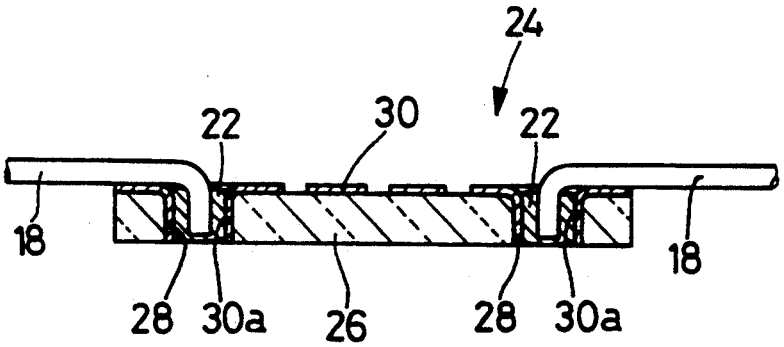
FIG. 4 is an elevational view in cross section indicating another embodiment of the present invention.

Referring to FIG. 4, there is illustrated another embodiment of the resistor element according to the present invention. In this resistor element 24, a planar ceramic substrate 26 has a pair of holes 28, 28 formed through the thickness thereof at its appropriate positions. As in the embodiment described above, an electrically resistive metallic layer 30 is formed in a suitable pattern on the upper bearing surface of the ceramic substrate 26. The layer 30 has integrally formed extensions 30*a* which cover the inner wall surfaces of each hole 28.

As in the preceding embodiment, the pair of lead wires 18, 18 are inserted suitable distances into the pair of holes 28, 28 of the ceramic substrate 26, with one of the opposite end portions of each wire 18 bent in a direction substantially perpendicular to the plane of the ceramic substrate 26. The end portions of the lead wires 18 which are inserted into the respective holes 28 of the substrate 26 are firmly secured by the electrically conductive adhesive 22 which fills each hole 28, whereby the lead wires 18 are electrically connected to the extensions 30*a* of the resistive metallic layer 30, which are formed on the inner wall surfaces of the respective holes 28.

While the present invention has been described in detail presently preferred embodiments for illustrative purpose only, it is to be understood that the present invention is not limited to the illustrated embodiments, but the invention may be embodied with various changes, modifications and improvements which may occur to those skilled in the art, without departing from the spirit and scope of the invention.

For instance, the apertures formed in the ceramic substrate are not limited to the cutouts 16, 16 or holes 28, 28, which may be replaced by other forms of apertures, which may or may not be formed through the entire thickness of the substrate.

Further, it is not essential that the electrically conductive adhesive 22 fills the entire volume of the apertures. It is also noted that the extensions 20*a*, 30*a* need not be provided to cover all of the surfaces of the substrate which define the apertures.

It will be understood that the substrate may have only one aperture so that only one of the two lead wires or conductors is electrically connected to the electrically resistive metallic film by an electrically conductive adhesive that at least partially fills the aperture.

What is claimed is:

1. A resistor element for determining a parameter, comprising:

a planar ceramic substrate having opposite major surfaces one of which provides a bearing surface, and at least one aperture formed through the thickness thereof;

an electrically resistive metallic layer which is substantially formed on said bearing surface of said ceramic substrate, said resistive metallic layer having at least one extension which covers at least an entire surface of inner side walls of said at least one aperture;

a pair of conductors for connecting said resistive metallic layer to an external circuit, at least one of said pair of conductors being inserted into a corresponding one of said at least one aperture of said ceramic substrate; and an electrically conductive adhesive at least partially filling each of said at least one aperture, for securing an end portion of the corresponding one of said pair of conductors to said ceramic substrate, said electrically conductive adhesive electrically connecting said at least one conductor to said at least one extension of said resistive metallic layer.

2. A resistor element according to claim 1, wherein said at least one aperture consists of two cutouts which are open on longitudinally opposite end faces of said ceramic substrate, respectively.

3. A resistor element according to claim 2, wherein said at least one conductor consists of two conductors each having an end portion which extends in a direction parallel to a plane of said ceramic substrate and which is inserted into the corresponding one of said two cutouts in said direction.

4. A resistor element according to claim 1, wherein said at least one aperture consists of two holes formed through a thickness of said ceramic substrate in longitudinally opposite end portions of said ceramic substrate.

5. A resistor element according to claim 4, wherein said at least one conductor consists of two conductors each having an end portion which extends in a direction perpendicular to a plane of said ceramic substrate and which is inserted into the corresponding one of said two holes in said direction.

6. A resistor element according to claim 1, wherein said ceramic substrate includes at least one rounded portion which bounds said bearing surface and said inner wall surface of said at least one aperture, each of said at least one rounded portion being covered by said electrically resistive metallic layer.

7. A resistor element according to claim 6, wherein said each rounded portion of the substrate has a radius of curvature of at least 5 μm.

8. A resistor element according to claim 7, wherein said each rounded portion of the substrate has a radius of curvature of at least 10 μm.

9. A resistor element according to claim 1, further comprising a protective coating layer formed of glass, for covering said electrically resistive metallic layer.

10. A resistor element according to claim 1, wherein said ceramic substrate is formed of alumina.

* * * * *